United States Patent [19]

Yoshida et al.

[11] Patent Number: 4,501,090

[45] Date of Patent: Feb. 26, 1985

[54] AUTOMATIC DOOR OPERATOR FOR SWING DOORS

[75] Inventors: Kei Yoshida; Masayuki Murokawa; Toshiaki Nomura, all of Tokyo, Japan

[73] Assignee: Chikura Kogyo Kabushiki Kaisha, Tokyo, Japan

[21] Appl. No.: 454,867

[22] Filed: Dec. 30, 1982

[30] Foreign Application Priority Data

Apr. 12, 1982 [JP] Japan ..... 57-60472

[51] Int. Cl.[3] ..... E05F 13/00

[52] U.S. Cl. ..... 49/264; 49/31; 49/336; 49/334

[58] Field of Search ..... 49/264, 273, 274, 334, 49/336, 31

[56] References Cited

U.S. PATENT DOCUMENTS 3,470,653 10/1969 Kalog ..... 49/334 X
3,874,117 4/1975 Boehm ..... 49/264
4,220,051 9/1980 Catlett ..... 49/334 X
4,333,270 6/1982 Catlett ..... 49/336

*Primary Examiner*—Kenneth Downey
*Attorney, Agent, or Firm*—Cushman, Darby & Cushman

[57] ABSTRACT

An automatic door operator for a swing door supported by a door supporting frame to swing about a vertical axis. The automatic door operator includes a mechanism for opening and closing the swing door, a drive for driving the door opening and closing mechanism to open the swing door, the drive including a prime mover for driving the door opening and closing mechanism, a door closer including a resilient device for storing part of mechanical energy provided by the drive in opening the swing door and for exerting driving force on the door opening and closing means by using the stored mechanical energy to close the door, a unit for electrically controlling the drive to swing the swing door, and a sensor for sensing a body accessing the door and thereby providing an electric signal to open the door to the controlling unit.

3 Claims, 15 Drawing Figures

LOW SPEED OPENING
CLOSED
OPENING STROKE
OPENED
CLOSING STROKE
CLOSED
HIGH SPEED OPENING
OFF
ON
(GRAPH 1) Swing door 1
(GRAPH 2) Mat switch 3
(GRAPH 3) Electric motor 19
(GRAPH 4) Photosensor 47 upon detection of 1st cut-out portion of cam 45
(GRAPH 5) Photosensor 47 upon detection of 2nd cut-out portion of cam 45
(GRAPH 6) Solenoid brake 33
(GRAPH 7) Compression force applied to compression spring 57
TIME

AUTOMATIC DOOR OPERATOR FOR SWING DOORS

BACKGROUND OF THE INVENTION

The present invention relates to an automatic door operator for use in swing doors.

FIG. 1 shows a typical well-known automatic swing door, in which a swing door 1 which rotates about a vertical axis is automatically opened and then closed by activating an accessing body sensing device such as mat switch 3. A signal from the mat switch 3 is transmitted through a cable 5 to a door operator 7 mounted on a header or transam 9 of a jamb or door supporting frame 8. In the operator 7, according to the signal supplied, an electric motor provided therein is energized. When the motor is energized a door swinging link mechanism 11 acting as an opening and closing means, connected through power transmission means to the electric motor, is actuated to open and close the door 1. However, when the power supply is stopped in this type of automatic swing door, the door must be opened and closed by hand. For example, in the case where an automatic swing door is also used as a fire or smoke door, the door is often left open when the power supply is stopped due to fire, since those escaping a fire usually do not stop to close the door. Thus, automatic swing doors in the prior art do not adequately perform fireproof and smokeproof functions when needed.

SUMMARY OF THE INVENTION

Accordingly, it is an object of the present invention to provide an automatic door operator for swing doors in which when a failure of the power supply occurs the door is automatically and completely closed, whereby the automatic door operator adequately serves as a door operator for fire or smoke doors.

This and other objects in view, the present invention provides an automatic door operator, for a swing door supported by a door supporting frame to swing about a vertical axis, comprising: means, adapted to be attached to the swing door, for opening and closing the swing door; means, connected to the opening and closing means, for driving the opening and closing means to open the swing door, the driving means including a prime mover for driving the opening and closing means; means for electrically controlling the driving means to swing the swing door; means for sensing a body accessing the swing door and thereby providing a signal to open the door to the controlling means; and a door closer connected to the door opening and closing means, the door closer including resilient means for storing part of the mechanical energy provided by the driving means in opening the swing door and for exerting a driving force on the door opening and closing means by using the stored mechanical energy to close the door.

BRIEF DESCRIPTION OF THE DRAWINGS

While the specification concludes with claims which particularly point out and distinctly define the subject matter which is regarded as the invention, it is believed the invention will be more clearly understood when considering the following detailed description and the accompanying drawings in which:

DETAILED DESCRIPTION OF THE PREFERRED EMBODIMENTS

Figure 1:
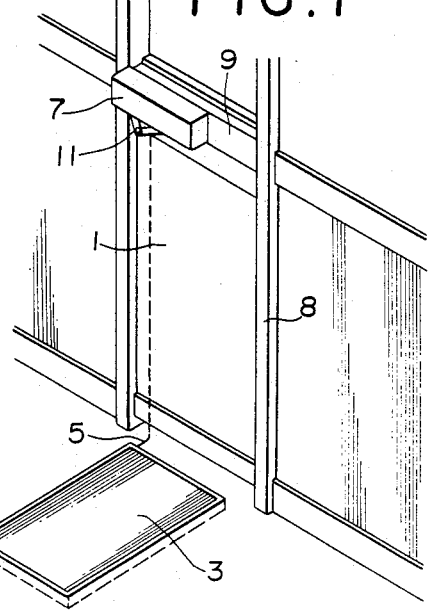
FIG. 1 is a perspective view illustrating the prior art automatic swing door.
Figure 2:
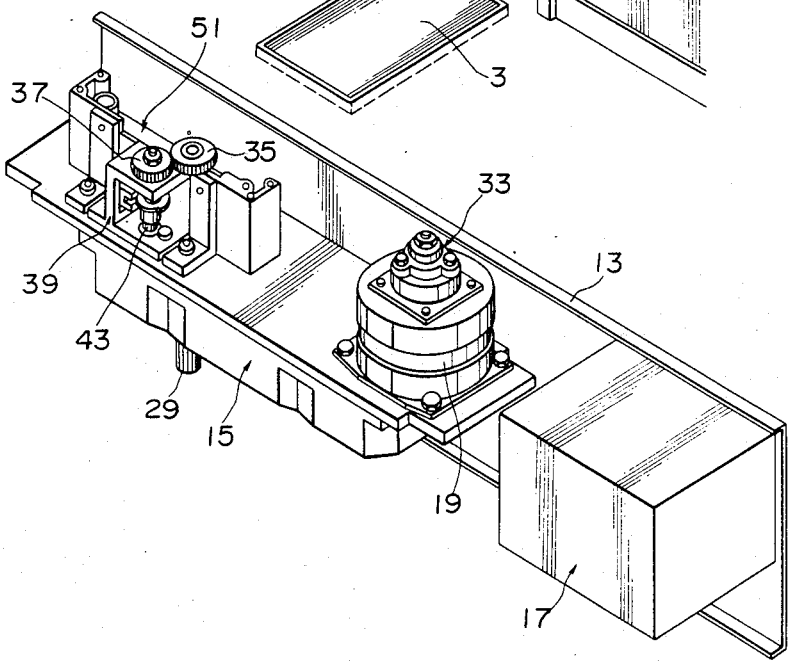
FIG. 2 is a perspective view illustrating one embodiment of the present invention.
Figure 3:
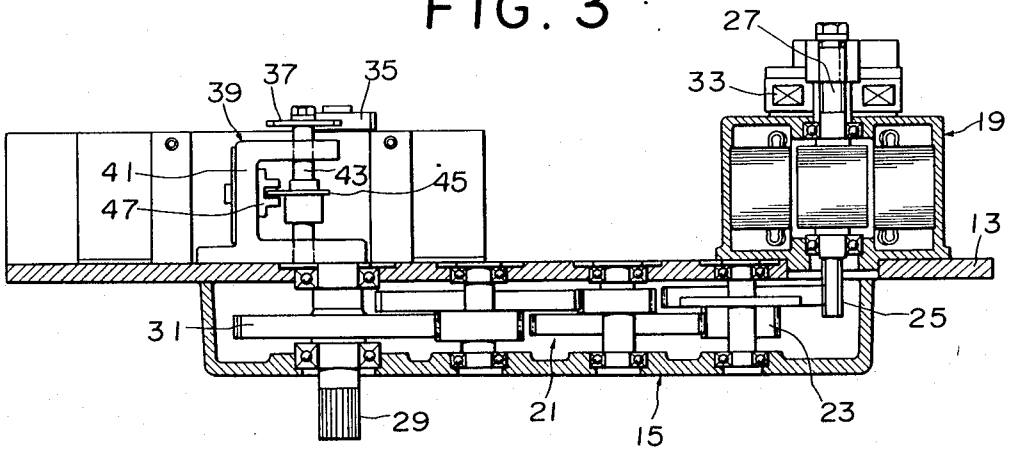
FIG. 3 is a lengthwise vertical section of the automatic door operator in FIG. 2.
Figure 4:
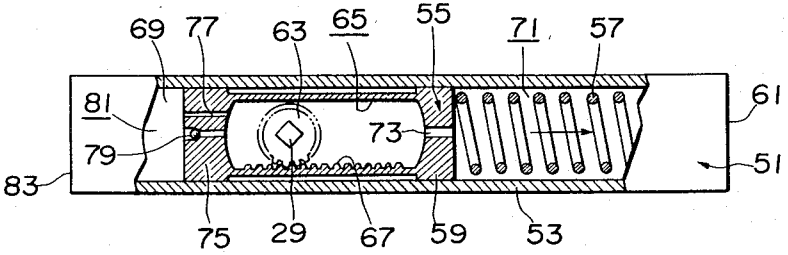
FIG. 4 is a plan view partly cut away and showing a door closer used in the automatic door operator in FIG. 2.

Referring to FIGS. 2 to 4, there is illustrated one embodiment of the present invention in which a reference numeral 13 designates a support plate made of metal or the like which is fixedly attached to the header 9 of the door supporting frame as shown in FIG. 1. Mounted on the support plate 13 are a drive unit 15 for driving the door swinging link mechanism 11, and a control unit 17 for electrically controlling the drive unit 15 to open the swing door 1. The drive unit 15 includes an electric motor 19 and a speed reducer 21 of a gear train, a first gear member 23 of which meshes with a gear 25 integrally formed with the lower end of a rotational shaft 27 of the electric motor 19. A shaft 29 of a last gear member 31 of the speed reducer 21 constitutes a driving shaft which is connected in a well known manner for transmitting a rotational force to a mechanism for opening and closing the door 1 such as door swinging link mechanism 11 shown in FIG. 1. On the upper end of the rotational shaft 27 of the electric motor 19, there is disposed a solenoid brake 33 so as to surround the rotational shaft 27. The solenoid brake 33 applies a braking force on the rotational shaft 27 when it is energized, thereby preventing the rotation of the drive shaft 27. Mounted on the upper end of the drive shaft 29 is a timing gear 35, which transmits rotation through another timing gear 37 to a door open angle detector 39 for detecting an open angle degree of the door 1 or a horizontal angle formed between the door 1 and door supporting frame 8. This detector 39 includes a generally channel shaped support member 41 mounted on the support plate 13, a rotational shaft 43, vertically and rotatably supported by upper and lower flanges of the support member 41, which carries the timing gear 37 on its upper end, a program cam 45 mounted around the rotational shaft 43, and a photosensor 47 attached to a web of the support member 41. The photosensor 47 receives the periphery of the program cam 45 into a slit formed therein to thereby detect cut-out portions formed in the cam 45 as it turns, so that the photosensor 47 provides a signal of a predetermined door open angle to a control unit 19 which will be described hereinafter, whereby a predetermined rotation angle of the drive shaft 29, i.e., a predetermined door open angle is detected. On the support plate 13, there is further mounted a door closer 51 of a type used in swing doors, which as seen from FIG. 4 comprises a hollow cylinder 53 horizontally attached to the support plate 13 and containing a viscous oil 69, a piston 55 slidably and sealingly fitted into the cylinder 53, a compression coil spring 57 one end of which is attached to a front end 59 of the piston 55 and the other end of which is attached to the inner wall of one of closed ends 61, and a pinion 63 fixedly mounted on the upper portion of the drive shaft 29 which sealingly passes through the cylinder 53 and further passes through an elongate opening 65 formed through the piston to extend axially. The pinion 63 engages with a rack 67 integrally formed with one side wall of the opening 65 to extend axially. When the swing door 1 is to be opened, the drive shaft 29 is rotated to move the piston 55 against the coil spring 57 in a direction indicated by the arrow in FIG. 4 via the rack and pinion engagement, in which event part of viscous oil 69 contained in a coil receiving space 71 of the cylinder 53 flows through an axial passage 73 formed through the front end 59 of the piston 55 into the opening 65 and then it flows through two passages, that is, a narrow axial passage 77 formed through a rear end 75 of the piston 55 and a check valve 79 provided in the rear end 75 into a rear space 81 defined between the rear end 75 and the rear closed end 83 of the cylinder 53. As a result, the compression spring 57 is caused to compress, and thereby store mechanical energy for subsequent usage. In closing the swing door 1, the spring 57 is released and urges the piston 55 to move toward the rear closed end 83 of the cylinder, so that the drive shaft 29 is rotated via the rack and pinion engagement in a direction to close the swing door 1. In this event, the check valve 79 is closed, and hence part of viscous oil 69 within the space 81 flows through only the narrow passage 77 into an opening 65 and then through the passage 73 into the space 71. Since the check valve 79 is closed in closing the door 1, the door can be automatically closed at an optimum speed by providing the narrow passage 77 with an appropriate cross-sectional area. The control unit 17 includes a conventional electrical control devices including timers. The unit 17 stores data as to door opening speed, door opening period and the like and controls the electric motor 19 and the brake 33 according to an open control signal from the mat switch 3 and an open angle signal from the door open angle detector 39 as will be described below.

Figure 5:
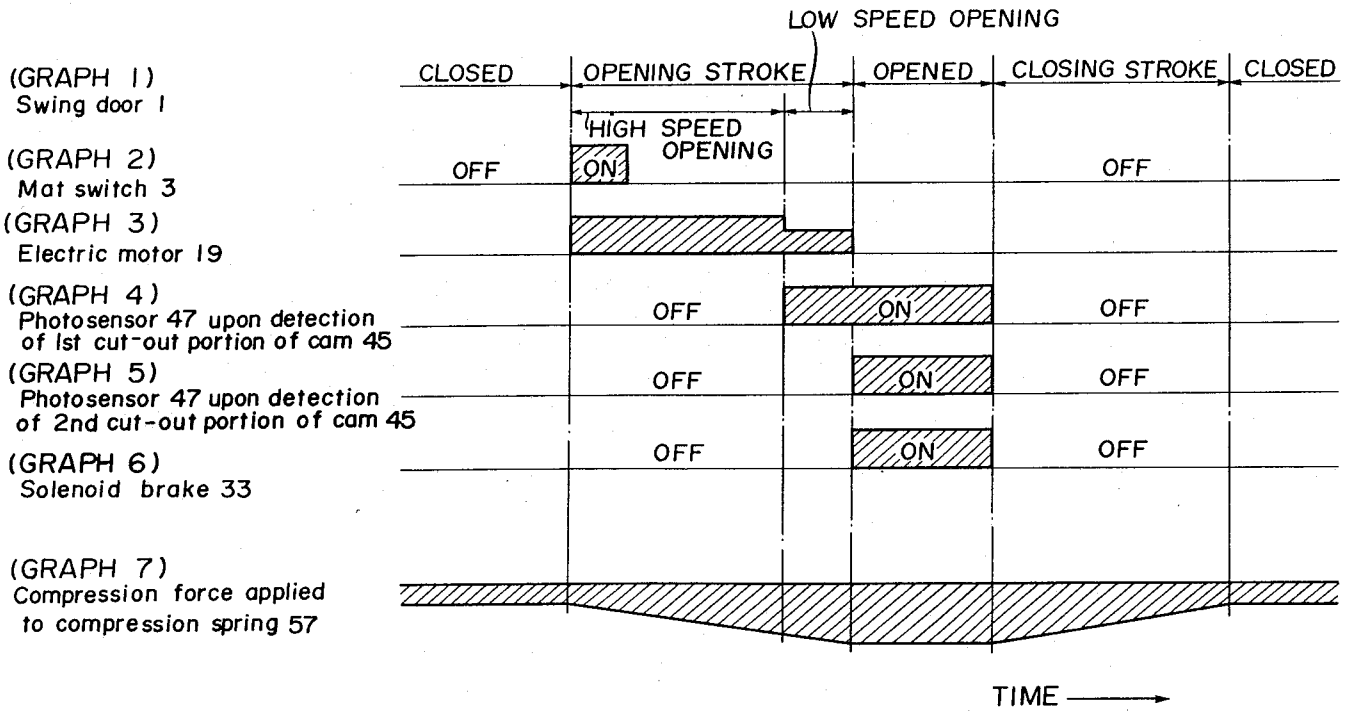
FIG. 5 is a time chart showing one aspect of the operation of an automatic swing door using the door operator in FIG. 2.
Figure 13:
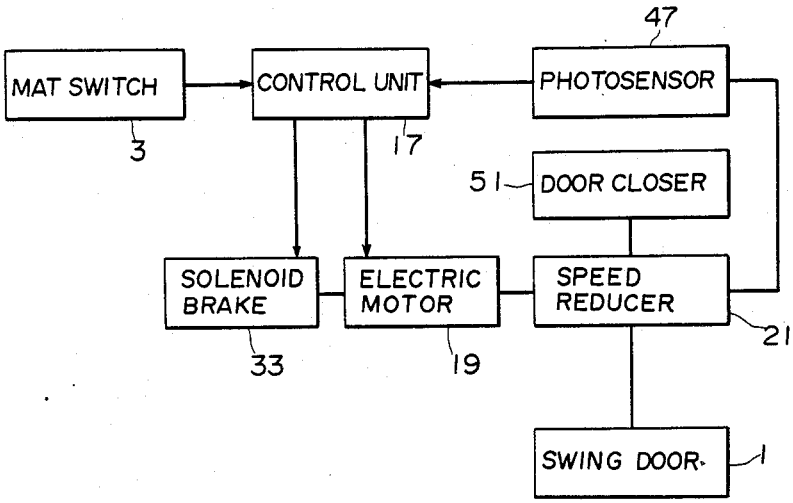
FIG. 13 is a block diagram of the automatic door operator in FIGS. 2 and 11.

Referring now to FIGS. 5 and 13, the operation of the automatic door operator will be described with respect to one aspect thereof. Assuming that the swing door 1 is in a closed condition as shown in GRAPH 1, the compression spring 57 is preloaded to apply a force closing the swing door 1. The mat switch 3 is activated as shown in GRAPH 2 when a person steps thereon, which then provides a door open control signal to the control unit 17, which causes the electric motor 19 to be connected to a power source (not shown) to thereby energize it. (GRAPH 3) Thus, the drive unit 15 is actuated to rotate the drive shaft 29 in a direction to open the swing door 1. In this case, the rotation speed of the electric motor 19 is set high, so that the swing door 1 is turned at a relatively high speed about its vertical hinged axis in an open direction. When the swing door 1 is opened to a predetermined angle relative to the header 9 of the door supporting frame, e.g. 70° for a door with a maximum open angle of 90°, the photosensor 47 detects the predetermined angle by detecting a first cut-out portion of the program cam (GRAPH 4 in FIG. 5) corresponding to the predetermined open angle of the swing door 1, and supplies a first open angle signal to the control unit 17 which in turn reduces the rotation speed of the electric motor 19 (GRAPH 3), so that the opening speed of the swing door 1 becomes lower and it slowly opens from the predetermined angle position slightly before the door 1 is completely opened. In the latter event, the photosensor 47 detects the open angle of the door 1 at this stage by sensing a second cut-out portion (not shown) of the program cam 45 and provides a second open angle signal to the control unit 17, so that the electric motor 19 is deenergized and simultaneously solenoid brake 33 is energized with the result that a braking force is applied to the rotational shaft 27 (GRAPH 5). As a result, the rotation of the drive shaft is immediately stopped and thus the swing door 1 is held in a completely open condition, e.g., 90°-open condition by the solenoid brake 33 for a predetermined time interval which datum is previously inputted into the control unit 17. During the above-described door opening stroke, the compression force applied to the compression spring 57 is gradually increased as the swing door 1 opens (GRAPH 7), and becomes maximum when the door 1 is completely opened.

After the predetermined time interval during which the swing door 1 is completely opened, the control unit 17 deenergizes the solenoid brake 33 to thereby release the rotational shaft (GRAPH 6), so that the drive shaft 29 is caused to be rotated in a direction to close the door 1 by a counterforce exerted by the compression spring 57 via the rack and pinion engagement. (GRAPH 7) Thus, the swing door 1 is closed at a speed defined by the door closer 51.

Figure 6:
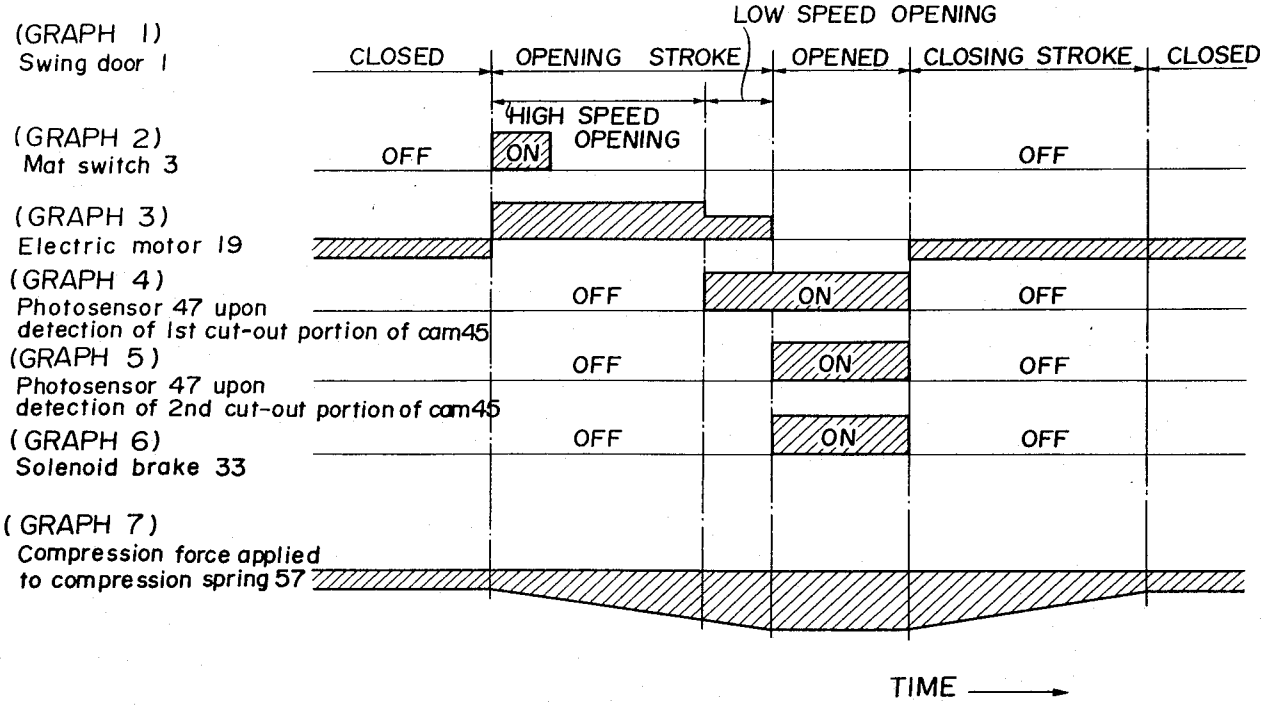
FIG. 6 is a time chart showing another aspect of the operation of an automatic swing door using the door operator in FIG. 2.

FIG. 6 illustrates a second operation of the automatic door operator, which differs from the first aspect of operation above described in that during the closing of the door a small force for closing the swing door 1 is applied to the drive shaft 29 by reversing slowly the electric motor 19 in addition to the counterforce exerted by the compression spring 57 on the drive shaft 29, ensuring the door 1 to be positively closed. (GRAPH 3) This reversal of the electric motor 19 is controlled by the control unit 17 in such a manner that the control unit 17 supplies the electric motor 19 with a current to rotate slowly that motor in a reverse direction relative to a direction to open the door 1. Although the driving force exerted by the door closer 51 on the drive shaft 29 becomes smaller at low temperatures due to an increase in viscosity of the viscous oil contained in the cylinder 83, in this second operation the door 1 is positively closed by the additional force exerted by the electric motor 19.

Figure 7:
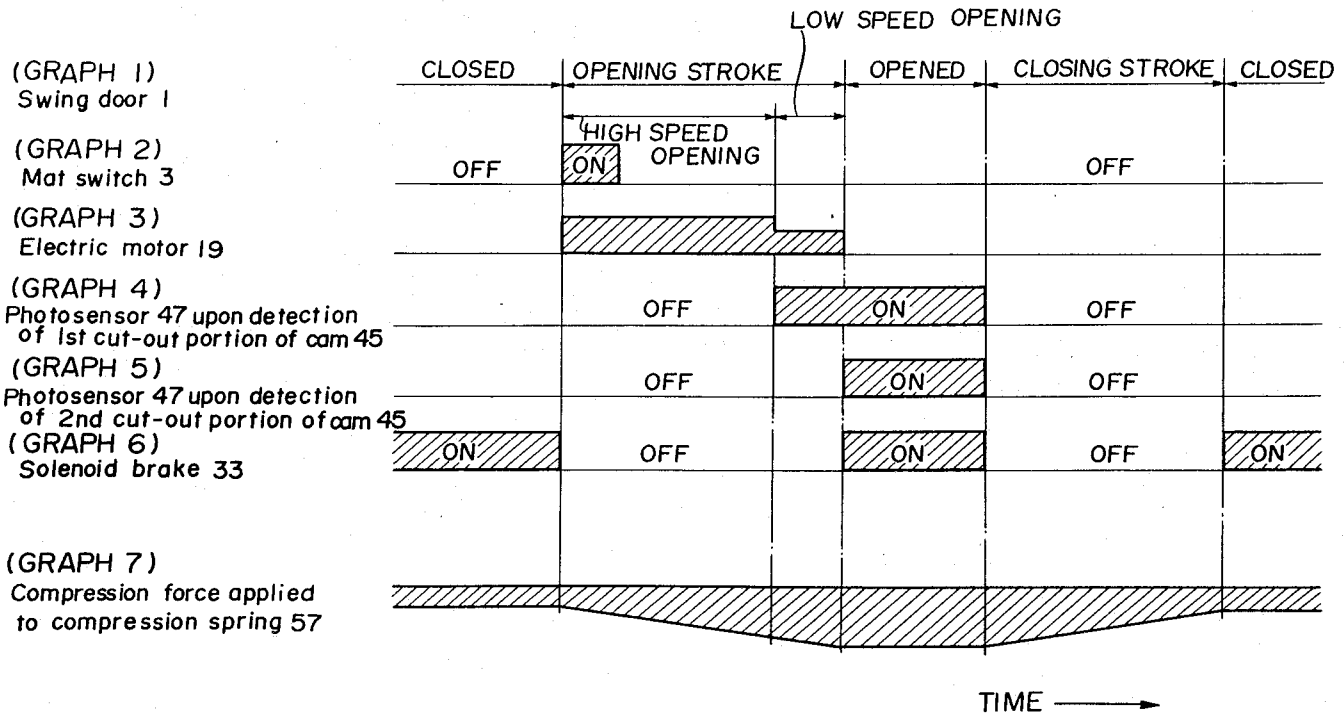
FIG. 7 is a time chart showing a still another aspect of the operation of an automatic swing door using the door operator in FIG. 2.

Referring to FIG. 7 a third operation of the first embodiment of the present invention will be described. This third operation differs from the first operation already described in that when the swing door 1 is closed, the photosensor 47 detects this state by sensing a third cut-out portion (not shown) formed in the program cam 45 and provides the control unit 17 with a signal to energize the solenoid brake 33, so that brake prevents the drive shaft from being rotated to thereby prevent the swing door 1 from being opened by wind and the like.

Figure 8:
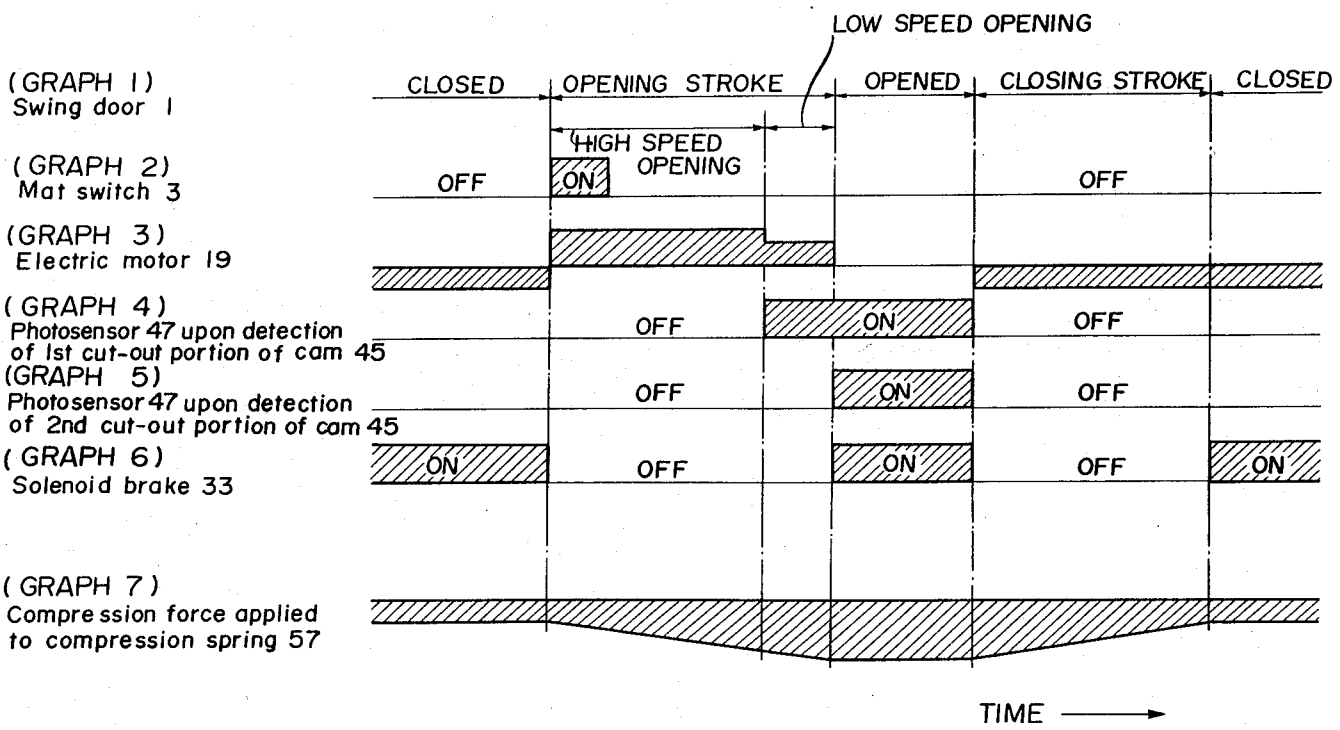
FIG. 8 is a time chart showing a further aspect of the operation of an automatic swing door using the door operator in FIG. 2.

FIG. 8 illustrates a fourth operation of the first embodiment, which differs from the second operation, described with reference to FIG. 6, in that when the swing door 1 is closed, the solenoid brake 33 is energized to prevent the rotation of the drive shaft 29 as in the third operation description in FIG. 7.

Although in the above embodiment, the rotational shaft 29 of the last gear member 31 passes through cylinder 53 of door closer 51, the shaft of pinion 63 and the rotational shaft of the last gear member 31 may be joined by mortise and tenon formed in opposed ends of those shafts.

Figure 9:
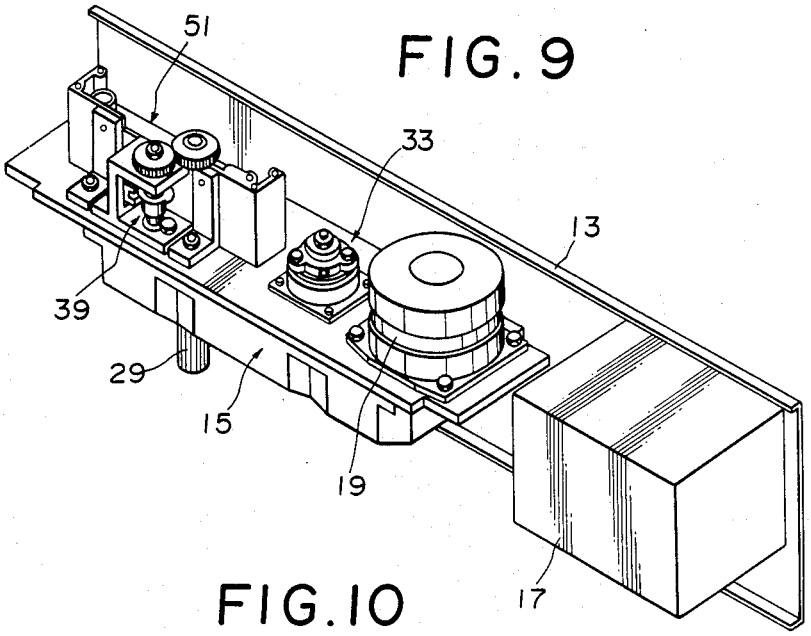
FIG. 9 is a perspective view illustrating a modified form of the automatic door operator in FIG. 2.
Figure 10:
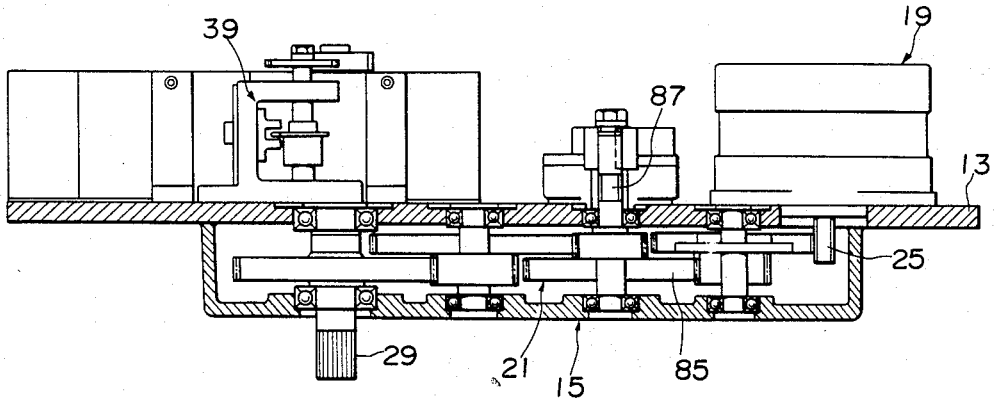
FIG. 10 is a lengthwise vertical section of the automatic door operator in FIG. 9.
Figure 14:
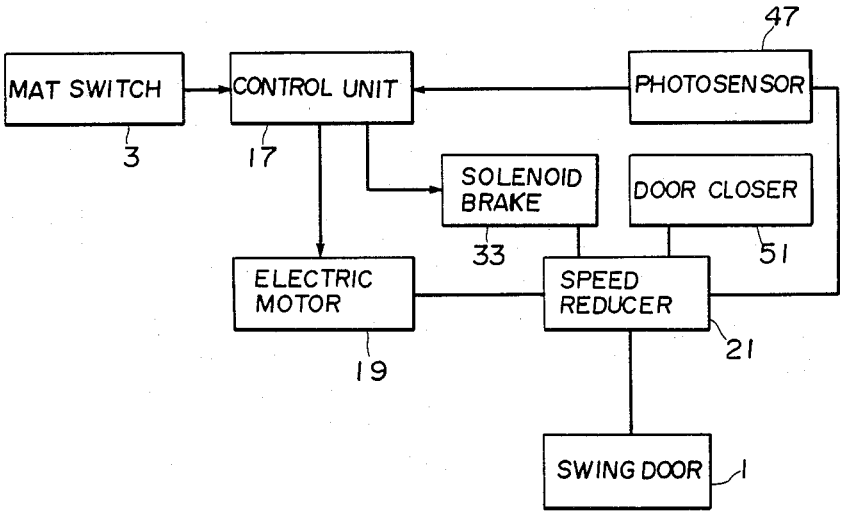
FIG. 14 is a block diagram of the automatic door operator in FIG. 9.

FIGS. 9 and 10 illustrate a modified form of the embodiment shown in FIGS. 2 to 5. The modification is that the solenoid brake 33 is disposed to surround a rotational shaft 87 of a second gear member 85 of the speed reducer 21, thereby applying a braking force to the rotational shaft 87 when energized. This modified form is preferable in the case where the height of the door operator needs to be reduced. The block diagram of this modification is shown in FIG. 14.

Figure 11:
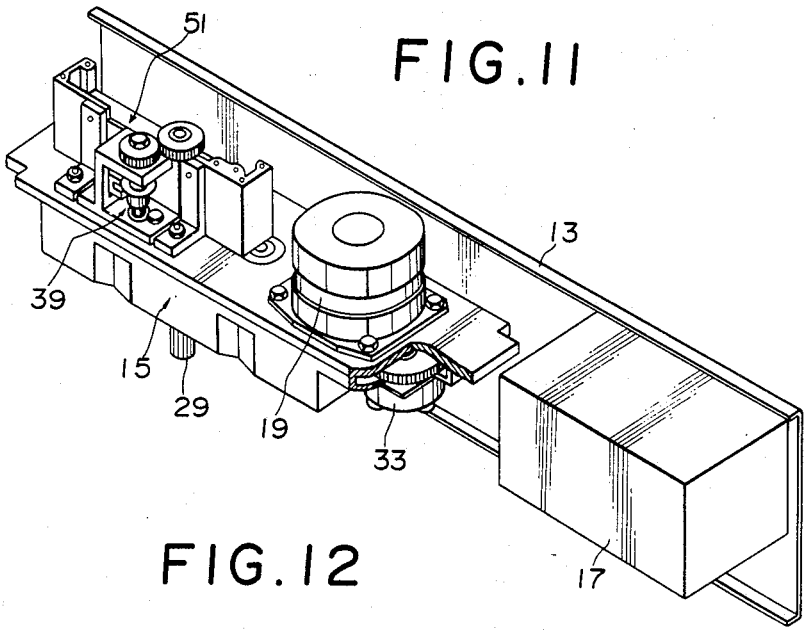
FIG. 11 is a perspective view illustrating a further modified form of the automatic door operator in FIG. 2.
Figure 12:
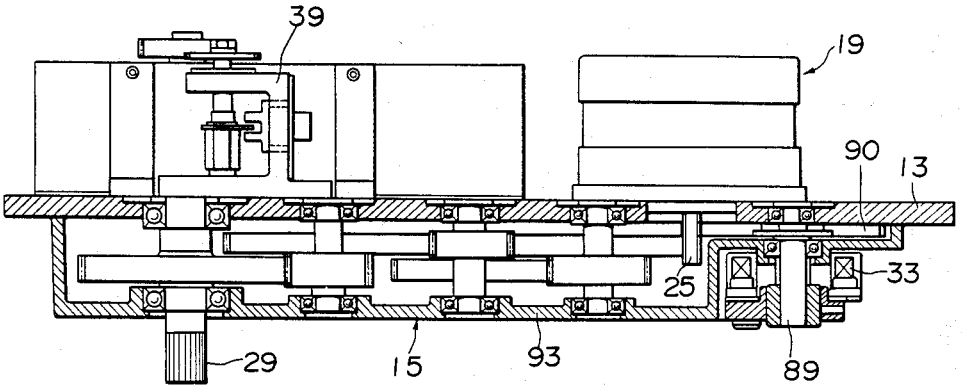
FIG. 12 is a lengthwise vertical section of the automatic door operator in FIG. 11.

In FIGS. 11 to 12, the solenoid brake 33 is disposed to surround a rotation shaft 89 of a gear member 90 which engages with the gear 25 of the rotation shaft 27 of the electric motor, the rotation shaft 89 of the gear member 90 being rotatably supported by the support plate 13 and the cover 93 of the speed reducer 21. The block diagram of this modification is shown in FIG. 13. This modified form is preferable where the height of the speed reducer 21 needs to be minimum.

Figure 15:
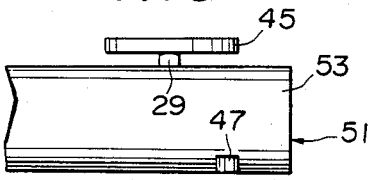
FIG. 15 is a front view of a modified form of the detector in FIG. 2.

FIG. 15 illustrates a modified form of the detector in FIG. 2, in which in place of timing gear 35 a program cam plate 45 is mounted on the upper end of the rotational shaft 29, and a photosensor 47 including a photoemitting element and photoreceiving element (not shown) is placed at one side of the cylinder 53 of the door closer 51 below the program cam 45. The photoemitting element emits light and the photoreceiving element receives light reflected by the program cam 45. The cut-out portions of the cam do not reflect light emitted from the photoemitting element, and thus the photosensor 47 detects the cut-out portions by not receiving any reflected light.

What is claimed is:

1. An automatic door operator for a swing door supported by a door supporting frame to swing about a vertical axis, comprising:

(a) opening and closing means attached to the swing door, for opening and closing the swing door;

(b) a support plate;

(c) an electric motor supported on one side of the support plate and having a rotation shaft;

(d) speed reducing means comprising a gear train disposed on the other side of the support plate and connected to the rotation shaft, the speed reducing means having a last gear member disposed remotely from the rotation shaft;

(e) a door closer supported on the one side of the support plate, including:

a hollow cylinder having closed opposite ends and containing an oil therein;

a piston member slidably and sealingly fitted into the cylinder and axially spring-biased to close the door, the piston member having a first passage and a second passage formed therethrough, each of said passages communicating one side of the cylinder to the other side, the second passage having a check valve incorporated therein so that the check valve is closed when the piston member is moved in a direction to close the door; and a rack member attached to the piston member to extend in the axial direction of the cylinder;

a drive shaft perpendicularly passing through and rotatably supported by the support plate so as to be connected to the opening and closing means for driving the opening and closing means, the drive shaft passing through the wall of the cylinder and having a pinion mounted on one end portion thereof to engage with the rack member of the piston member, and the drive shaft further having the last gear of the speed reducing means mounted on the other end portion thereof;

(g) control means for electrically controlling the motor to swing the door;

(h) sensing means for sensing a body accessing the door to thereby provide an electric signal to the control means to energize the motor to open the swing door; and (i) detecting means for detecting an open angle degree of the swing door, the detecting means including:

a program cam operatively connected to the drive shaft for being rotated; and a photo detector for detecting the shape of the program cam to thereby provide an open angle degree signal to the control means for controlling the rotation of the motor.

2. An automatic door operator as recited in claim 1, wherein the control means is further adapted to energize the motor to close the swing door when the door is closed by the door closer via the drive shaft and the opening and closing means.

3. An automatic door operator as recited in claim 2, wherein the drive shaft consists of a first shaft having the pinion mounted thereon and a second shaft having the last gear of the speed reducing means mounted thereon, the first shaft and the second shaft being joined in alignment with each other by a mortise and a tenon formed in opposed or butted ends thereof.

* * * * *